US008353668B2

(12) United States Patent
Propheter-Hinckley et al.

(10) Patent No.: US 8,353,668 B2
(45) Date of Patent: Jan. 15, 2013

(54) AIRFOIL INSERT HAVING A TAB EXTENDING AWAY FROM THE BODY DEFINING A PORTION OF OUTLET PERIPHERY

(75) Inventors: Tracy A. Propheter-Hinckley, Manchester, CT (US); Amanda Jean Learned, Manchester, CT (US); Shawn J. Gregg, Wethersfield, CT (US)

(73) Assignee: United Technologies Corporation

( * ) Notice: Subject to any disclaimer, the term of this patent is extended or adjusted under 35 U.S.C. 154(b) by 641 days.

(21) Appl. No.: 12/378,681

(22) Filed: Feb. 18, 2009

(65) Prior Publication Data

US 2010/0209229 A1 Aug. 19, 2010

(51) Int. Cl.
*F01D 5/18* (2006.01)
*F01D 9/02* (2006.01)

(52) U.S. Cl. ..... 416/96 A; 415/115; 415/208.1

(58) Field of Classification Search ..... 415/115, 415/208.1; 416/96 A, 97 R
See application file for complete search history.

(56) References Cited

U.S. PATENT DOCUMENTS

| | | | | |
|---|---|---|---|---|
| 4,962,640 | A | 10/1990 | Tobery | |
| 5,971,707 | A | 10/1999 | Uematsu et al. | |
| 6,065,928 | A * | 5/2000 | Rieck et al. | 415/115 |
| 6,398,486 | B1 | 6/2002 | Storey et al. | |
| 6,561,757 | B2 | 5/2003 | Burdgick et al. | |
| 6,951,444 | B2 * | 10/2005 | Dellmann et al. | 415/115 |
| 7,121,796 | B2 | 10/2006 | Burdgick et al. | |
| 7,131,816 | B2 | 11/2006 | Synnotter et al. | |
| 7,204,675 | B2 | 4/2007 | Texier | |

* cited by examiner

*Primary Examiner* — Anh Mai
(74) *Attorney, Agent, or Firm* — O'Shea Getz P.C.

(57) ABSTRACT

Disclosed are examples of flow-directing elements, airfoil inserts, and assemblies thereof. A flow-directing element has an inner buttress with an airfoil extending outwardly therefrom. The airfoil includes a cavity that extends within the airfoil to an exit port disposed in the inner buttress. A shelf disposed about the buttress defines the exit port, and the shelf includes a discourager extending into the cavity. An airfoil insert has a tubular body, with an outlet at one end. A plate affixed to the body at the outlet partially blocks the outlet, and includes a tab extending away from the body and defining a portion of an outlet periphery. Upon assembly of the flow directing element and the insert, the tab interacts with the discourager to direct a coolant to the exit port while restricting leakage of the coolant back into the cavity, between the airfoil insert and the flow-directing element.

9 Claims, 3 Drawing Sheets

AIRFOIL INSERT HAVING A TAB EXTENDING AWAY FROM THE BODY DEFINING A PORTION OF OUTLET PERIPHERY

BACKGROUND OF THE INVENTION (1) Field of the Invention

The present disclosure generally relates to flow-directing elements such as vanes and blades used in gas turbine engines, and more specifically to flow-directing elements, airfoil inserts and assemblies of flow-directing elements and airfoil inserts and assemblies of flow-directing elements and airfoil inserts.

(2) Description of the Related Art

Gas turbine engines extract energy from expanding gases in a turbine section disposed immediately downstream of a combustor section. Alternating stages of flow-directing elements, for example stationary vanes and rotating blades, operate at elevated temperatures. The operational temperatures may, in some instances, exceed the melting temperature of their base material. For this reason, flow-directing elements in a turbine utilize thermal barrier coating systems and various cooling systems to improve their durability.

One type of cooling system is a convective cooling system. A convective cooling system utilizes coolant, such as pressurized air from a forward compressor section of the gas turbine engine, to remove heat from the flow-directing elements. The coolant circulates through internal cavities and passages, removing heat via convection, before exiting. Various features and separate details are known to increase the heat transfer coefficient of the coolant inside flow-directing elements. One such detail is a perforated airfoil insert, also known as an impingement tube or a baffle tube.

When disposed inside an internal cavity and spaced from the cavity wall, the insert improves heat removal. The coolant discharges from the perforations in high velocity jets, spraying across the gap between the insert and cavity wall. By impinging against the cavity wall, the heat transfer coefficient increases thus enhancing the cooling effectiveness.

Airfoil inserts are generally affixed to the flow-directing element to prevent liberation and possible engine damage. Since the flow-directing element typically has a greater coefficient of thermal expansion than the insert, only one end of the insert is affixed, while the other end is left free. Relative movement between the insert's free end and the flow-directing element opens a gap between the insert and the flow-directing element at the free end. The gap allows a portion of the high-pressure coolant exiting the insert to leak back between the insert and the cavity wall. This leaking coolant interferes with the impingement cooling jets, thus reducing the heat transfer coefficient and cooling effectiveness.

Those skilled in the art will recognize that it is preferable to minimize the volume of coolant leaking back into the cavity between the insert and flow-directing element. An enhanced seal between the free end of an insert and a flow-directing element is therefore needed.

BRIEF SUMMARY OF THE INVENTION

In accordance with the exemplary embodiments presented herein, flow-directing elements, airfoil inserts and assemblies thereof are disclosed in such detail as to enable one skilled in the art to practice such embodiment without undue experimentation.

An exemplary airfoil insert has a tubular shaped body with an outlet at one end. A plate affixed to the body at the outlet partially blocks the outlet, and includes a tab defining a portion of the outlet periphery. The tab extends away from the body.

An exemplary flow-directing element has an inner buttress with an airfoil extending therefrom. The airfoil includes an internal cavity extending within the airfoil to an exit port in the inner buttress. A shelf disposed about the inner buttress defines the exit port, and the shelf includes a discourager extending back into the cavity.

An exemplary flow-directing assembly includes a flow-directing element having an inner buttress with an airfoil extending outwardly therefrom. The airfoil includes an internal cavity that extends within the airfoil to an exit port in the inner buttress. A shelf disposed about the inner buttress defines the exit port, and the shelf includes a discourager extending back into the cavity. An airfoil insert, disposed inside the cavity, has a tubular body with an outlet at one end. A plate affixed to the body at the outlet partially blocks the outlet, and includes a tab defining a portion of an outlet periphery. The tab extends in a direction that is away from the body of the airfoil insert. The tab interacts with the discourager to direct coolant to the exit port while restricting leakage of coolant back into the cavity, between the airfoil insert and the flow-directing element.

These and other objects, features and advantages of the present invention will become apparent in view of the following detailed description and accompanying figures of multiple embodiments, where corresponding identifiers represent like features between the various figures.

DETAILED DESCRIPTION OF THE INVENTION

Figure 1:
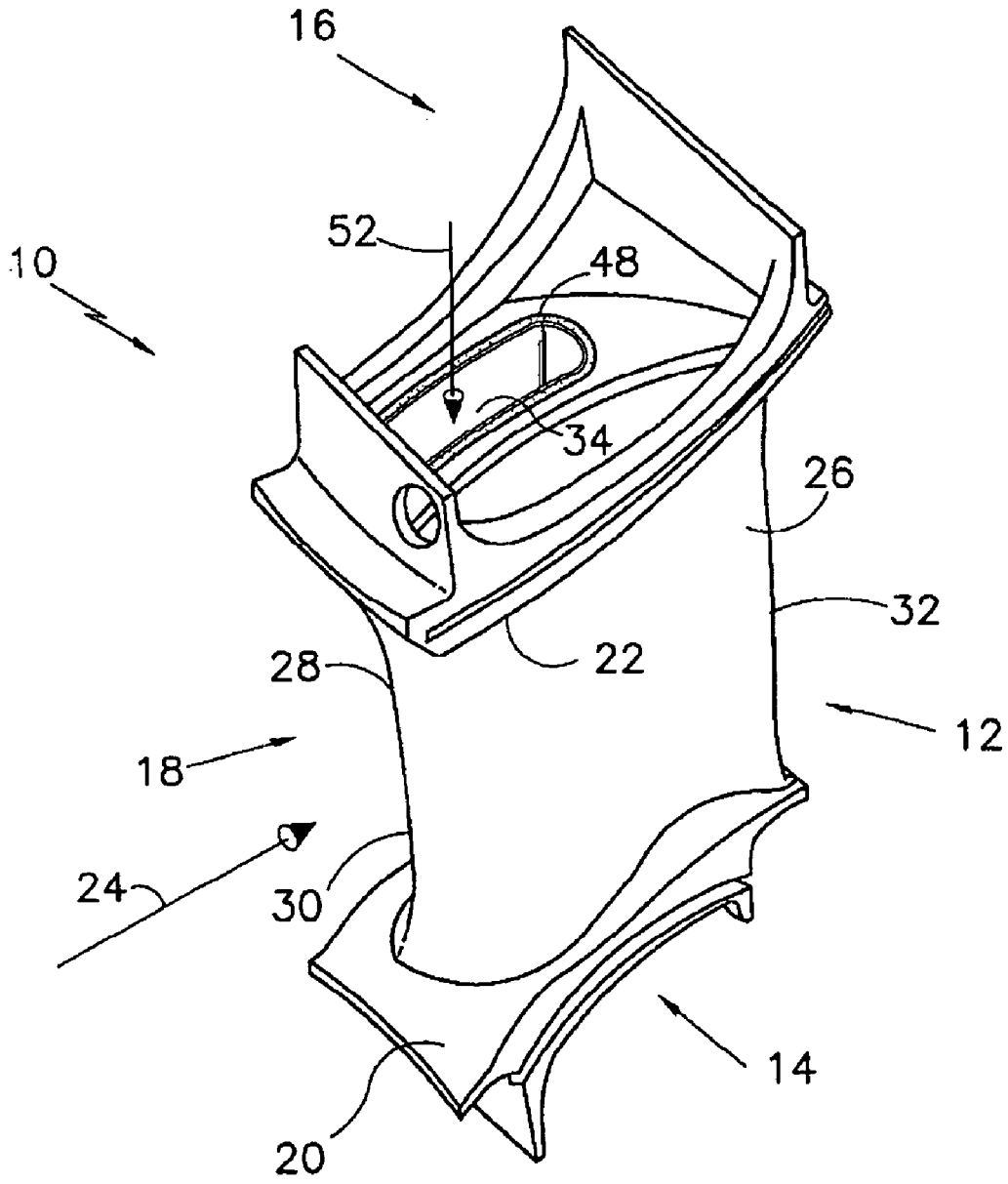
FIG. 1 illustrates a top front isometric view of a flow-directing assembly in accordance with an exemplary embodiment of the present invention.

With attention first directed to FIG. 1, a flow-directing assembly 10 in accordance with an exemplary embodiment is presented. A flow-directing element 12 includes in inner buttress 14 an outer buttress 16 and an airfoil 18 spanning between. An inner flow path surface 20 and an outer flow path surface 22 direct a primary fluid stream 24 across the airfoil 18. The airfoil 18 has a pressure or concave surface 26 and an opposite, suction or convex surface 28 (not shown). The concave surface 26 and the convex surface 28 join at a forward leading edge 30 and a rearward trailing edge 32. One or more internal cavities 34 are disposed inside of the airfoil 18 and may open through the inner buttress 14, outer buttress 16 or both.

Figure 2:
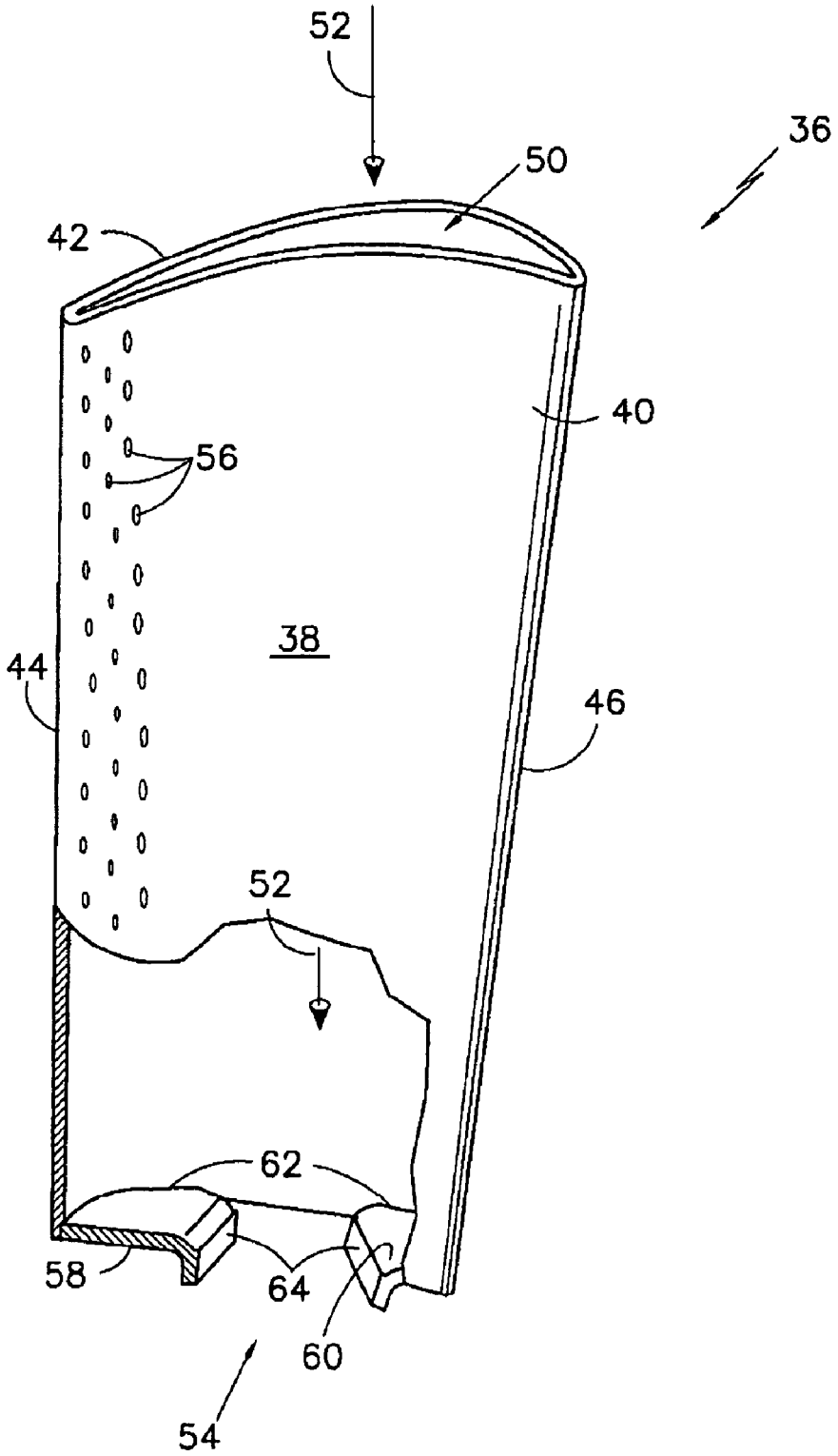
FIG. 2 illustrates a partial sectional isometric view of an airfoil insert in accordance with an exemplary embodiment of the present invention.

With attention now directed to FIG. 2, an airfoil insert 36 has a tubular shaped body 38 made from a high-temperature capable material such as WASPALOY™ sheet for example. The body 38 has a concave surface 40 and a convex surface 42, joined at a leading edge 44 and a trailing edge 46. A joint 48 (FIG. 1) affixes the insert 36 to the flow-directing element 12 about an inlet 50 periphery. The inlet 50 accepts a coolant 52 such as high-pressure air into the body 38. The joint 48 is formed by welding or brazing for example, and may be disposed at one or more discrete locations about the inlet 50 or may extend about the entire inlet 50 periphery for improved sealing.

The downstream end of the body 38 has an outlet 54 that is disposed adjacent to the inner buttress 14 (FIG. 1) when assembled into a flow-directing element 12. The outlet 54 may have a smaller cross sectional area than the inlet 50 for further pressurizing the coolant 52 inside the body 38. A number of apertures 56 perforate the insert body 38 for discharging the pressurized coolant 52 as impinging jets against the walls of the internal cavity 34.

The cross sectional area of the outlet 54 is restricted by a leading edge plate 58 and/or a trailing edge plate 60 affixed to the body 38 at joints 62 by welding or brazing for example. In the example shown, the leading edge plate 58 extends approximately 0.39 inch (10 millimeters) from the leading edge 44, and the trailing edge plate 60 extends approximately 0.16 inch (4 millimeters) from the trailing edge 44. The leading edge plate 58 blocks a greater cross sectional area of the outlet 54 than the trailing edge plate 60 in this example. In another example (not shown), the trailing edge plate 60 blocks a greater cross sectional area of the outlet 54 than the leading edge plate 58. In yet another example (not shown), the trailing edge plate 60 blocks an equal cross sectional area of the outlet 54 as the leading edge plate 58.

A tab 64 disposed on the leading edge plate 58 and/or trailing edge plate 60 extends outwardly, away from the body 38, and defines a portion of the outlet 54 periphery. In the example shown, two tabs 64 extend perpendicularly between approximately 0.05 inches (1.3 millimeters) and 0.1 inch (2.6 millimeters) from the leading and trailing edge plates 58, 60. The tabs 64 direct the coolant 52 away from the insert's leading edge 44 and trailing edge 46 and towards the center of the body 38 to the outlet 54.

Figure 3:
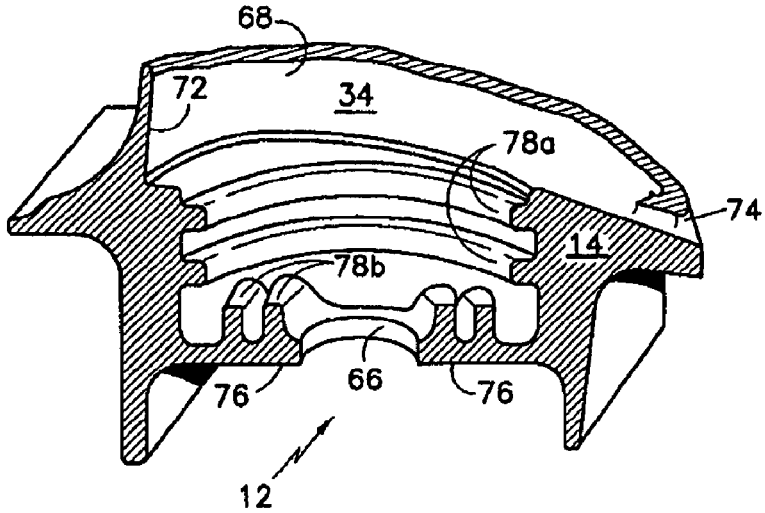
FIG. 3 illustrates a detailed, isometric, partial sectional view of a flow-directing element in accordance with an exemplary embodiment of the present invention.

With attention now directed to FIG. 3, a flow-directing element 12 has an inner buttress 14 with an internal cavity 34 discharging at an exit port 66 as illustrated. The cavity 34 conforms to the airfoil 18 shape (FIG. 1) and includes a concave surface 68 and an opposite convex surface 70 (not shown), joined by a leading edge portion 72 and a trailing edge portion 74. The cross sectional area of the exit port 66 is defined by a shelf 76 extending about the inner buttress 14 and into the cavity 34. The shape of the exit port 66 may be circular as illustrated, oval, rectangular or some other shape.

A flow discourager 78*a* extends from the inner buttress 14 and into the cavity 34 approximately 0.020 inches (0.5 millimeters) for example. In the example illustrated in the figures, multiple discouragers 78*a* extend from the inner buttress 14. A flow discourager 78*b* also extends from the shelf 76 and into the cavity 34 approximately 0.06 inches (1.5 millimeters) for example. In the example illustrated, multiple discouragers 78*b* extend from the shelf 76. The discouragers 78*b* are disposed on the shelf 16 adjacent the leading edge portion 72 and the trailing edge portion 74 of the cavity 34. In some examples, more discouragers 78*b* are disposed adjacent the leading edge portion 72 than the trailing edge portion 74, and in other examples, more discouragers 78*b* are disposed adjacent the trailing edge portion 72 than the leading edge portion 74. In yet other examples, there are an equal number of discouragers 78*b* disposed adjacent the trailing edge portion 72 as the leading edge portion 74

Figure 4:
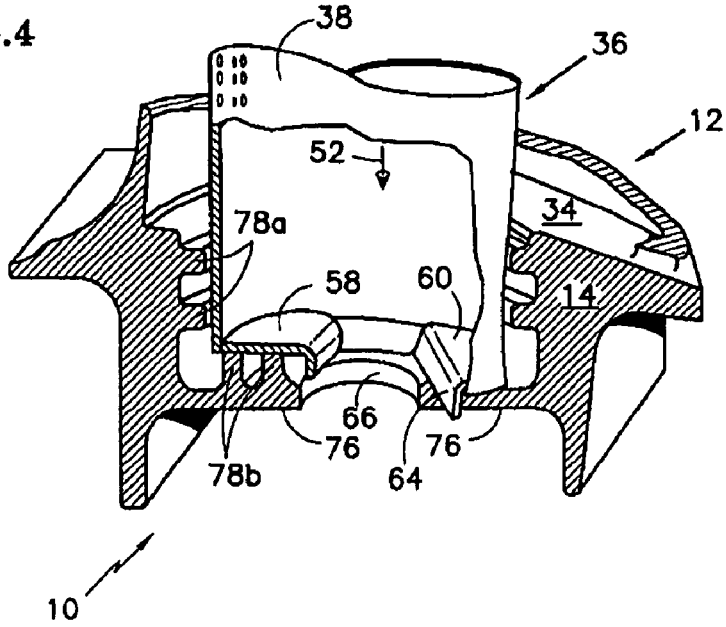
FIG. 4 illustrates a detailed, isometric, partial sectional view of the airfoil insert of FIG. 2 assembled with the flow-directing element of FIG. 3.

Lastly, with attention now directed FIG. 4, a flow-directing assembly 10 is illustrated. An insert 36 is assembled into a flow-directing element 12 to form a restriction of coolant 52 at the inner buttress 14. The leading edge plate 58 and trailing edge plate 60 interact with the flow discouragers 78*b* disposed on the shelf 76, and the insert body 38 interacts with the flow discouragers 78*a* disposed about the buttress 14. The interaction of the insert 36 and the flow discouragers 78*a*, 78*b* forms a series of restrictions and reduces the volume of coolant 52 flowing back into the internal cavity 34. Note that the tabs 64 overlap the flow discouragers 78*b* on the leading and trailing edge plates 58, 60, directing the coolant 52 inward, toward the exit port 66.

In general, the flow directing element 12 has a greater coefficient of thermal expansion than the insert 36. Since the insert 36 is affixed to the flow-directing element 12 at the inlet 50 by joint 48 (FIG. 1), a gap forms between the leading and trailing edge plates 58, 60 and the flow discouragers 78*b* during normal operation. Analytical calculations of the illustrated example predict this gap to open approximately 0.032 inches (0.8 millimeters).

Without the combination of flow discouragers 78*b* interacting with the tabs 64 and flow discouragers 78*a* interacting with the insert body 38, a volume of coolant 52 could flow back into the internal cavity 34. Instead, the coolant 52 is directed inward and towards the exit port 66 by the leading and trailing edge plates 58, 60 and tabs 64. The tabs 64 overlap the flow discouragers 78*b* to further restrict the flow of coolant 52 back into the cavity 34.

While the present invention is described in the context of specific embodiments thereof, other alternatives, modifications and variations will become apparent to those skilled in the art having read the foregoing description. For example, a cooled vane segment is illustrated throughout the disclosed examples, while the present invention could similarly be applied to rotating blades. The embodiments disclosed are applicable to gas turbine engines used in the aerospace industry and much larger turbines used for the power-generating industry. The specific dimensions provided in the written description are exemplary only and should not be construed as limiting in any way. Accordingly, the present disclosure is intended to embrace those alternatives, modifications and variations as fall within the broad scope of the appended claims.

What is claimed is:

1. An airfoil insert comprising:

a tubular body having an outlet, a leading edge portion and a trailing edge portion;

a first plate affixed to said body at the outlet and proximate said leading edge portion, said first plate partially blocking the outlet; and a second plate affixed to said body at the outlet and proximate said trailing edge portion, said second plate partially blocking the outlet, said second plate being separate from said first plate;

wherein at least one of said first and second plates includes a tab defining a portion of the outlet periphery, said tab extending away from said body.

2. The airfoil insert of claim 1, wherein said body includes a concave surface, a convex surface and the surfaces being joined together at the leading edge portion and the trailing edge portion.

3. The airfoil insert of claim 2 wherein said tab bridges between the concave surface and the convex surface.

4. The airfoil insert of claim 3, wherein said tab extends perpendicularly from at least one of said first and second plates.

5. The airfoil insert of claim 1, wherein said first plate blocks a first cross sectional area of the outlet and said second plate blocks a second cross sectional area of the outlet, and wherein the second cross sectional area is greater than the first cross sectional area.

6. The airfoil insert of claim 1, wherein said first plate blocks a first cross sectional area of the outlet and said second plate blocks a second cross sectional area of the outlet, and wherein the first cross sectional area is greater than the second cross sectional area.

7. The airfoil insert of claim 1, wherein said first plate blocks a first cross sectional area of the outlet and said second plate blocks a second cross sectional area of the outlet, and wherein the first cross sectional area is equal to the second cross sectional area.

8. The airfoil insert of claim 4, wherein said tabs extends between 0.05 inch (1.3 millimeters) and 0.1 inch (2.6 millimeters) from at least one of said first and second plates.

9. The airfoil insert of claim 1, wherein said body further comprises an inlet and the cross sectional area of the inlet is greater than the cross sectional area of the outlet.

* * * * *